US010329065B2

(12) United States Patent
Boekeloo et al.

(10) Patent No.: US 10,329,065 B2
(45) Date of Patent: Jun. 25, 2019

(54) EASY OPEN FLOW WRAPPERS

(71) Applicant: Printpack Illinois, Inc., Elgin, IL (US)

(72) Inventors: Jeffrey Allen Boekeloo, Acworth, GA (US); Rajesh Suryanarayanan, Powder Springs, GA (US); Jason L. Stufflebeam, Marietta, GA (US); Edward J. Cigallio, Winston, GA (US)

(73) Assignee: Printpack Illinois, Inc., Elgin, IL (US)

( * ) Notice: Subject to any disclaimer, the term of this patent is extended or adjusted under 35 U.S.C. 154(b) by 331 days.

(21) Appl. No.: 15/127,511

(22) PCT Filed: Mar. 20, 2015

(86) PCT No.: PCT/US2015/021716
§ 371 (c)(1),
(2) Date: Sep. 20, 2016

(87) PCT Pub. No.: WO2015/143299
PCT Pub. Date: Sep. 24, 2015

(65) Prior Publication Data

US 2017/0174408 A1 Jun. 22, 2017

Related U.S. Application Data

(60) Provisional application No. 61/955,972, filed on Mar. 20, 2014.

(51) Int. Cl.
*B32B 3/00* (2006.01)
*B65D 75/58* (2006.01)
(Continued)

(52) U.S. Cl.
CPC ..... *B65D 75/5827* (2013.01); *B65B 9/06* (2013.01); *B65B 61/18* (2013.01); *B65D 65/14* (2013.01); *B65D 75/20* (2013.01); *B65D 75/585* (2013.01)

(58) Field of Classification Search
CPC ..... B65D 75/5827; B65D 65/14
See application file for complete search history.

(56) References Cited

U.S. PATENT DOCUMENTS

2013/0320019 A1 12/2013 Tinoco et al.

FOREIGN PATENT DOCUMENTS

EP 0043171 A1 1/1982
WO 2011/146616 A1 11/2011

OTHER PUBLICATIONS

PCT International Search Report and Written Opinion for PCT/US2015/021716 dated Jun. 1, 2015 (11 pages).
(Continued)

*Primary Examiner* — Elizabeth E Mulvaney
(74) *Attorney, Agent, or Firm* — Eversheds Sutherland (US) LLP

(57) ABSTRACT

Easy open flow wrappers are provided that include a flexible wrapper body formed from a flexible wrapper body film, the flexible wrapper body having a front panel and a back panel sealed together along one longitudinal seam and two lateral end seams containing a product therein. At least one line of weakness (24) substantially extends around a portion of the flexible wrapper body to define a removable portion (28) of the flexible wrapper body, such that application of a separation force upon the removable portion separates the removable portion from the flexible wrapper body at the at least one line of weakness and forms an opening in the flexible wrapper body. A flexible film member (26) is disposed over and extending beyond the at least one line of weakness, in which the flexible film member is configured to prevent pre-separation of the removable portion from the flexible wrapper body.

38 Claims, 3 Drawing Sheets

(51) Int. Cl.

| | |
|---|---|
| ***B65B 9/06*** | (2012.01) |
| ***B65B 61/18*** | (2006.01) |
| ***B65D 65/14*** | (2006.01) |
| ***B65D 75/20*** | (2006.01) |

(56) References Cited

OTHER PUBLICATIONS

PCT Written Opinion for PCT/US2015/021716 dated Feb. 22, 2016 (4 pages).

EASY OPEN FLOW WRAPPERS

CROSS-REFERENCE TO RELATED APPLICATIONS

This application is a U.S. national stage application of International Application No. PCT/US2015/021716, filed Mar. 20, 2015, which claims the benefit of U.S. Provisional Application No. 61/955,972, filed Mar. 20, 2014, the disclosures of which are incorporated herein by reference.

BACKGROUND

The present application relates generally to packaging for containing various products. More particularly, the present application relates to an easy open flow wrapper to be used in any packaging process such as horizontal or vertical form, fill, and seal (FFS) suitable for rigid or semi-rigid products.

Generally speaking, most rigid or semi-rigid articles that are packed in a flow wrapper using horizontal or vertical FFS equipment are done at extremely high packing speeds. The principle of a horizontal flow wrapper machine, for example, is that a flat film is formed into a tube through a folding box and after forming the tube, a set of rotating sealing wheels makes a longitudinal seal, e.g. a fin seal or lap seal. The sealing wheels making the longitudinal seal are responsible for the transport through the machine together with some guiding wheels. The products move over a horizontal conveyer belt and run via the folding box into the formed tube. Once the product is placed into the tube, the cross-seals, also call end seals, are formed through the cross-sealing jaws. In most applications, the end seal of a flow wrapper is formed together with the beginning seal of the following flow wrapper. During sealing, the film is cut to split the adjacent flow wrapper and the cutting knife is generally built into the sealing jaws.

A standard flow wrapper is typically opened at a profiled end seal, which typically contains serrations that aid in the opening of the flow wrapper. This tear is generally not guided, which means that the opening is unpredictable and does not allow for controlled opening of the flow wrapper. A particular problem occurring in the opening of a flow wrapper in the cross direction with pre-cuts or other opening initiations is that these various opening mechanisms are stopped by either the product contained therein or the longitudinal seal of the flow wrapper, which is generally situated in the middle of the flow wrapper. Thus, once the tear reaches the product or this longitudinal seal the tear stops or becomes unpredictable. Furthermore, if the tear power is increased, a piece of the flow wrapper generally brakes off, or the tear continues in a random, unpredictable way.

Various solutions have been offered to address this unpredictable nature in tearing a flow wrapper. One of these solutions suggest pre-cutting/scoring of the flow wrapper at the sides of the tube or on the longitudinal seal. This would allow the consumer to tear across the flow wrapper exposing the product while allowing the consumer to eat out of the wrapper, which provides a clean, mess free experience. However, the issue with this approach is the tear is not typically controllable across the flow wrapper and in the case where the cut is not made in the longitudinal seal the tear is generally stopped by the seal thereby making the tear unpredictable.

Other solutions have been proposed such as the inclusion of a tear strip in the flow wrapper. This tear strip is sealed to the inside of the flow wrapper and allows the tear to be guided along the tape. However, if a tear tape is affixed to the flow wrapper in the cross direction, the tear will still stop at the longitudinal seal while tearing the flow wrapper beginning from the tear tape initiation. Furthermore, most of the tear tapes in the market are not heat-sealable but rather cold-sealable with a pressure sensitive adhesive already on the tape, which disadvantageously results in high costs and negative effects on the packing speeds.

Another proposed solution is perforation of the flow wrapper to achieve easy opening and more opening predictability. This perforation can be achieved either by die cutting or laser scoring the flow wrapper. Although such perforation can achieve an easy opening and more predictable opening feature, the depth of the perforation must be precisely controlled or a piece of the flow wrapper can break off during packing due to the web being under tension during the filling process. Furthermore, the depth of the perforation must be controlled to prevent barrier loss, thus the perforation must be performed within a sealed area.

Thus, there exists a need to provide an easy open flow wrapper that can be opened with predictability and minimal force without prematurely opening or separating during manufacturing or packaging, with minimal loss, if any, of its barrier properties, and capable of being utilized on standard packaging equipment without significant reduction in packaging speed.

SUMMARY

Embodiments of the present description address the above-described need by providing an easy open flow wrapper, methods for their manufacture, and use.

The present teachings provide for a flexible film arrangement for forming an easy open flow wrapper, in which the flexible film arrangement includes a flexible wrapper body film having at least one line of weakness substantially extending laterally across a portion of the flexible wrapper body film to define a removable portion in the flexible wrapper body film. The flexible film arrangement also comprises a flexible film member disposed over and extending beyond the at least one line of weakness, in which the flexible film member is configured to prevent pre-separation of the removable portion from the flexible wrapper body film.

The present teachings further provide for a method of fabricating a flexible film arrangement for forming an easy open flow wrapper. The method includes providing a flexible wrapper body film, applying a flexible film member over a portion of the flexible wrapper body film, and forming at least one line of weakness in the flexible wrapper body film substantially extending laterally across a portion of the flexible wrapper body film to define a removable portion in the flexible wrapper body film. Thus, the method results in having the flexible film member overlap and extend beyond the at least one line of weakness, so as to prevent pre-separation of the removable portion from the flexible wrapper body film.

The present teachings also provide for an easy open flow wrapper that includes a flexible wrapper body formed from a flexible wrapper body film, the flexible wrapper body having a front panel and a back panel sealed together along one longitudinal seam and two lateral end seams containing a product therein. At least one line of weakness substantially extends around a portion of the flexible wrapper body to define a removable portion of the flexible wrapper body, such that application of a separation force upon the removable portion separates the removable portion from the flexible wrapper body at the at least one line of weakness and forms an opening in the flexible wrapper body. A flexible film member is disposed over and extending beyond the at least one line of weakness, in which the flexible film member is configured to prevent pre-separation of the removable portion from the flexible wrapper body.

The present teachings also provide for a method of packaging a product in an easy open flow wrapper. The method includes providing a flexible wrapper body film having at least one line of weakness defining a removable portion in the flexible wrapper body film and a flexible film member applied over and extending beyond the at least one line of weakness, folding the flexible wrapper body film about the product and forming a longitudinal sealed seam by joining opposite longitudinal edges of the flexible wrapper body film, and forming two lateral end sealed seams. The flexible wrapper body film is configured such that applying a separation force upon the removable portion separates the removable portion from the flexible wrapper body film at the at least one line of weakness and forms an opening in the flexible wrapper body film. The flexible film member is configured to prevent pre-separation of the removable portion from the flexible wrapper body film.

BRIEF DESCRIPTION OF DRAWINGS

The present teachings are illustratively shown and described in reference to the accompany drawings, in which.

DETAILED DESCRIPTION

Figure 1A:
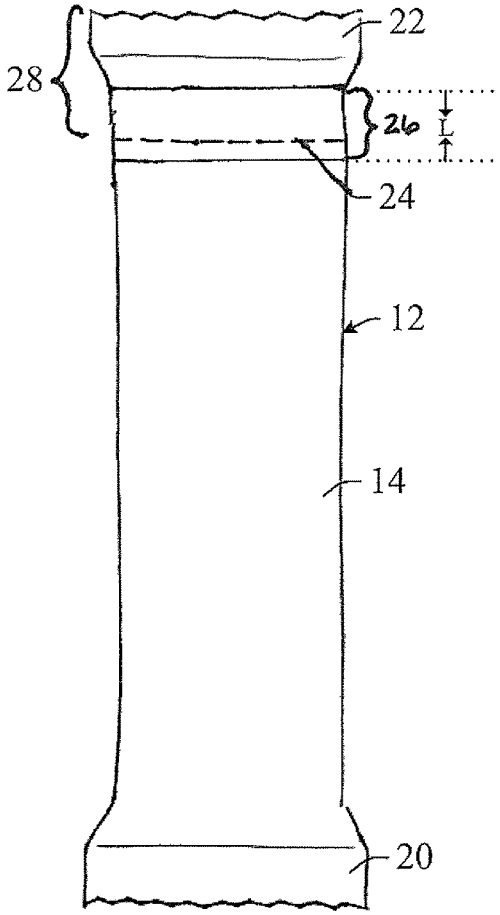
FIG. 1A is a front view of an easy open flow wrapper according to one embodiment.

The present teachings are directed to an easy open flow wrapper for rigid or semi-rigid products that allows for an easy and guided opening of the wrapper without premature separation or opening of the wrapper during packaging and filling techniques, e.g. FFS. Also provided herein are methods for manufacturing and use of the easy open flow wrapper. Parameters of different steps, components, and features of the embodiments are described separately, but may be combined consistently with this description and claims to enable other embodiments as will be understood by those skilled in the art.

Generally described, a flexible film arrangement is used to form the easy open flow wrapper. The flexible film arrangement includes a flexible wrapper body film having at least one line of weakness defining a removable portion in the flexible wrapper body film and a flexible film member applied over and extending beyond the at least one line of weakness. In certain embodiments, a roll of flexible film comprising the flexible film arrangement may be used to form the easy open flow wrapper. The easy open flow wrapper may be formed from the flexible film arrangement, for example, by a horizontal or vertical FFS process using heat sealing, cold sealing, ultrasonic sealing, radio frequency welding, induction welding or combinations thereof to form the one or more longitudinal seams and two lateral end seams. The easy open flow wrapper includes a flexible wrapper body formed from the flexible film arrangement which is folded around a product and sealed to fully enclose the product. Opposing longitudinal edges of the flexible wrapper body film are bonded together to form a longitudinal seam, e.g. a fin seal or a lap seal, which extends along a back panel of the flexible wrapper body. Opposing ends of the wrapper are bonded together to form lateral sealed seams at the ends of the product. Thus, the easy open flow wrapper includes a front panel, a back panel, a longitudinal seam on the back panel, and two lateral end seams.

The flexible wrapper body film may be formed from a single or multi-layer film using one or more flexible film materials suitable for use in packaging the rigid or semi-rigid product concerned. For example, in certain embodiments, the flexible film materials may include one or more layers of one or more paper-based materials, polymeric materials, metallized polymeric materials, metallic foils, or combinations thereof. Non-limiting examples include single layer or multi-layer films of suitable polymers, including but not limited to polyolefins, such as polyethylene terephthalate (PET), polypropylene (PP), polyamide (PA), and coated paper, it being understood that many other polymers, copolymers, and combinations thereof are also suitable. These materials may be produced as a cast or blown film and may be subsequently bi-axially or mono-axially oriented. Further functionality may be added by coating the materials by a vacuum deposition, aqueous deposition, spray process or other means. In one embodiment, the flexible wrapper body film is formed from a multi-layer laminate of a polymeric material or metallic foil, such as aluminum, on one side and a polymeric material on the other side. When the flexible wrapper body film is wrapped about the product, the metallic foil can be positioned on the inside facing the product and the polymeric material can be positioned on the outside. The polymeric material may be printed on or otherwise marked with information for the consumer.

The flexible wrapper body film also includes at least one line of weakness in the flexible wrapper body film. The at least one line of weakness extends around a portion of the flexible wrapper body to define a removable portion of the flexible wrapper body. In some embodiments, the at least one line of weakness may penetrate to a certain depth of the flexible wrapper body film, i.e. less than the thickness of the flexible wrapper body film, while in other embodiments, may penetrate entirely through the flexible wrapper body film. In certain embodiments, the at least one line of weakness extends from a first back panel portion, around and across a front panel portion, and terminates on a second back panel portion. For example, the at least one line of weakness may begin on the back panel between the longitudinal seal and one longitudinal side, continues around to and across the front panel, and then continues around to the back panel where it terminates on the opposite side of the longitudinal seal between the second longitudinal side and the longitudinal seal. Thus, the at least one line of weakness defining the removable portion extends substantially, and in some instances entirely, around the flexible wrapper body, such that application of a separation force upon the removable portion separates the removable portion from the flexible wrapper body at the at least one line of weakness and forms an opening in the flexible wrapper body. The term separation force as used herein, is defined as a force, such as pulling or twisting, in a direction away from the flexible wrapper body film or the flexible wrapper body sufficient to separate the removable portion therefrom.

The at least one line of weakness may be a die cut, score line, or perforated line, or any combination thereof formed in the flexible wrapper body film. The at least one line of weakness is formed in the flexible wrapper body film at a position which allows application of a separation force upon the removable portion to separate the removable portion from the flexible wrapper body at the at least one line of weakness, forming an opening in the flexible wrapper body. In certain embodiments, the line of weakness is located in the flexible wrapper body film between the two lateral end seams of the flexible wrapper body. In one embodiment, the line of weakness is disposed at about 3.0 mm to about 15.0 mm from one of the two lateral end seams. In another embodiment, the line of weakness is disposed within an upper fifth of the flexible wrapper body, in which the upper fifth extends from one of the two lateral end seams. In certain embodiments, the line of weakness is disposed a first distance away from the first lateral end seam, in which the first distance is from about one tenth to about one fifth of a second distance that extends from the first lateral end seam to the second lateral end seam.

A flexible film member is disposed over the at least one line of weakness and at least a portion of the removable portion of the flexible wrapper body film. The flexible film member extends beyond the at least one line of weakness defining the removable portion onto an overlapping region of the remaining flexible wrapper body film. The flexible film member is configured to prevent pre-separation of the removable portion from the flexible wrapper body. The term pre-separation as used herein, is defined as separation of the removable portion from the flexible wrapper body film or flexible wrapper body that occurs prior to a user intentionally exerting a separation force upon the removable portion of the flexible wrapper body to form a traverse opening thereof, e.g. separation that results during manufacturing, packaging, or transportation. In certain embodiments, the flexible film member is also configured to impede moisture or gas from passing through the flexible wrapper body film through the line of weakness.

In certain embodiments, the length of the flexible film member may be sufficiently long so as to provide a large enough surface to prevent pre-separation of the removable portion from the flexible wrapper body film or flexible wrapper body. In some embodiments, the length of the flexible film member may be at least about 6 mm to about 20 mm at the longest point. In certain embodiments, the length of the flexible film member may be about 12.5 mm. As used herein, the length (L) of the flexible film member refers to the longitudinal distance between the top and bottom edges of the flexible film member (i.e., the length is perpendicular to the width of the flexible film member between the opposed ends of the flexible film member). The width of the flexible film member should be sufficient to overlap and extend beyond the at least one line of weakness that is formed in the flexible wrapper body film. For example, in some embodiments the width of the flexible film member may be at least about 20 mm to about 100 mm. In certain embodiments, the width of the flexible film member may be about 69 mm. The thickness of the flexible film member in accordance with the present teachings may be sufficient so as to afford stability to the flexible film member in order to impart the desired functionality. For example, in some embodiments the thickness of the flexible film member may be at least about 0.6 mils (15 microns) to about 3.5 mils (88.9 microns). In certain embodiments, the thickness of the flexible film member may be about 2.5 mils (63.5 microns).

The flexible film member, like the flexible wrapper body film, may be formed using any flexible film materials suitable for use in packaging the product concerned. The flexible film member may be formed as a laminate or non-laminate, a co-extruded film, a cast film, an adhesive label, or the like. For example, in certain embodiments, the flexible film member may be a non-barrier or barrier structure including one or more layers of one or more paper-based materials, polymeric materials, metallized polymeric materials, metallic foils, and combinations thereof. Non-limiting examples include single layer or multi-layer films of suitable polymers, including but not limited to polyolefins, such as polyethylene terephthalate (PET), polypropylene (PP), polyamide (PA), and coated paper, it being understood that many other polymers, copolymers, and combinations thereof are also suitable. These materials may be produced as a cast or blown film and may be subsequently bi-axially or mono-axially oriented. Further functionality may be added by coating the materials by a vacuum deposition, aqueous deposition, spray process or other means.

In certain embodiments, the flexible film member may be disposed on the flexible wrapper body film, such that when the flexible wrapper body film is folded and sealed about the product, the flexible film member is positioned on the inside of the wrapper facing the product contained therein. In alternative embodiments, the flexible film member may be disposed on the flexible wrapper body film, such that when the flexible wrapper body film is folded and sealed about the product, the flexible film member is positioned on the outside of the wrapper. Depending on the desired characteristics of the easy open flow wrapper and the location of the flexible film member disposed thereon, the flexible film material of the flexible film member may be selected to impart the desired properties to the wrapper, i.e., transparency, or in some instances may further comprise printing, such as color, designs, graphics and other indicia, thereon.

Figure 1B:
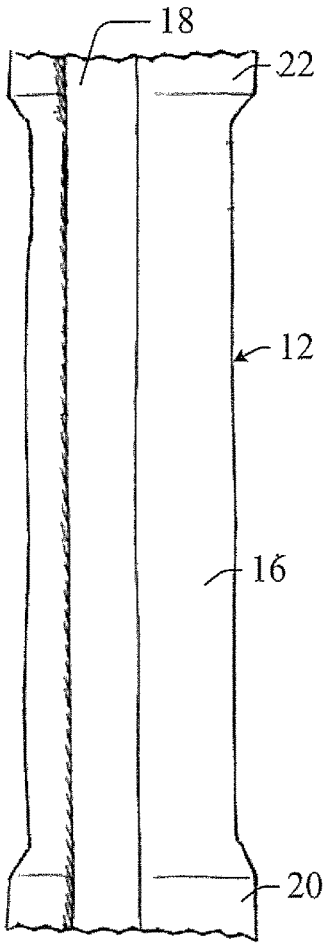
FIG. 1B is a back view of the embodiment depicted in FIG. 1A.
Figure 2A:
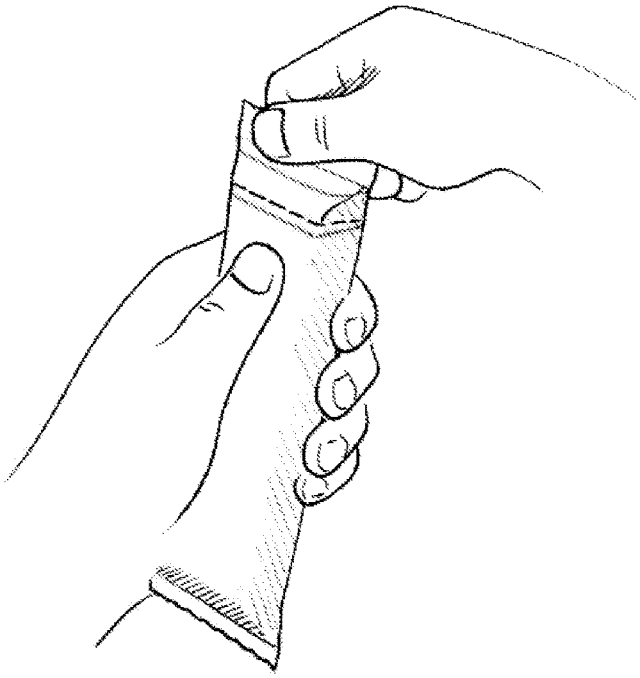
FIGS. 2A-2B are schematic illustrations of the easy open flow wrapper shown in FIGS. 1A and 1B being opened.
Figure 2B:
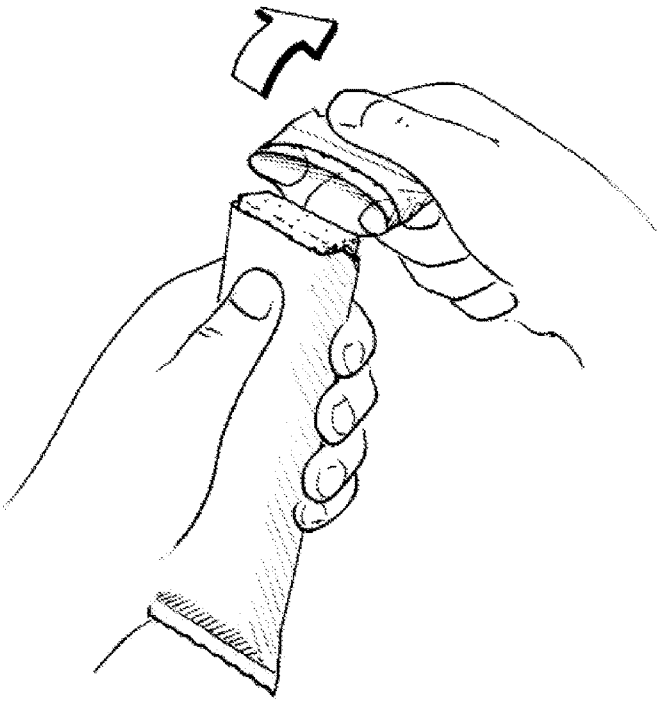

An exemplary embodiment of an easy open flow wrapper is illustrated in FIGS. 1A and 1B. The easy open flow wrapper 10 includes a flexible wrapper body 12 having a front panel 14 and a back panel 16 sealed together along one longitudinal seam 18 and two lateral ends seals 20 and 22 containing a product therein (not shown). The flexible wrapper body 12 includes at least one line of weakness 24 substantially extending laterally around a portion of the flexible wrapper body 24 to define a removable portion 28 of the flexible wrapper body 12. The at least one line of weakness 24 defines the removable portion 28, such that application of a separation force upon the removable portion 28 separates the removable portion 28 from the flexible wrapper body 12 at the at least one line of weakness 24 and forms an opening in the flexible wrapper body 12, as illustrated in FIGS. 2A and 2B. The easy open flow wrapper 10 also includes a flexible film member 26 disposed over and extending beyond the at least one line of weakness 24. The flexible film member 26 is configured to prevent pre-separation of the removable portion 28 from the flexible wrapper body 12. A schematic illustration of opening the exemplary easy open flow wrapper depicted in FIGS. 1A and 1B is illustrated in FIGS. 2A and 2B, including grasping the easy open flow wrapper and applying a separation force upon the removable portion, thereby forming an opening in the flexible wrapper body and exposing the product contained therein.

Figure 3A:
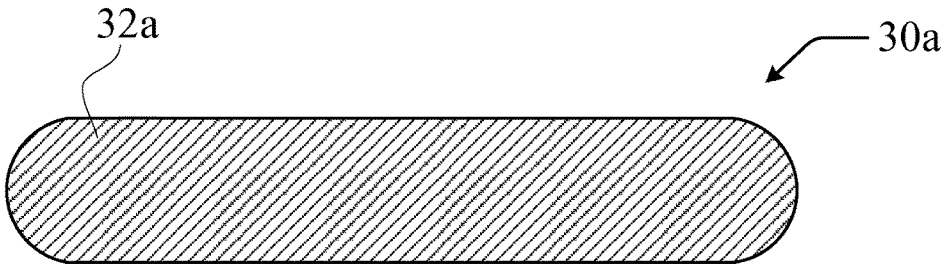
FIG. 3A is a back view of one embodiment of the flexible film member depicted in the easy open flow wrapper shown in FIGS. 1A and 1B.
Figure 3B:
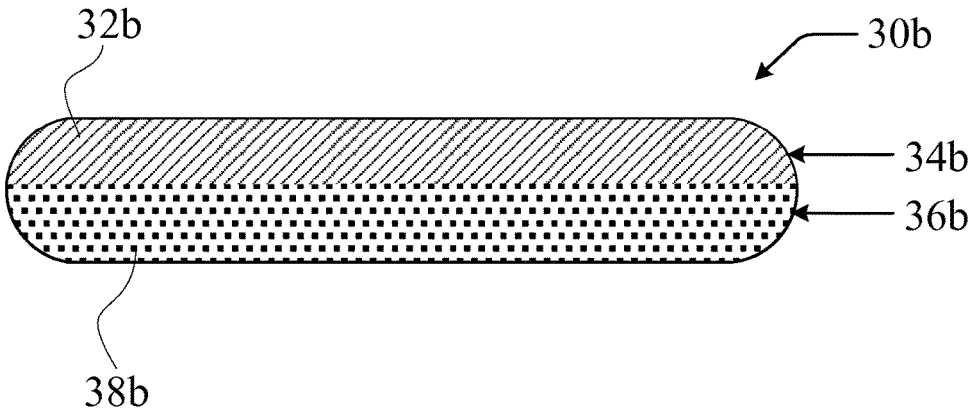
FIG. 3B is a back view of another embodiment of the flexible film member depicted in the easy open flow wrapper shown in FIGS. 1A and 1B.
Figure 3C:
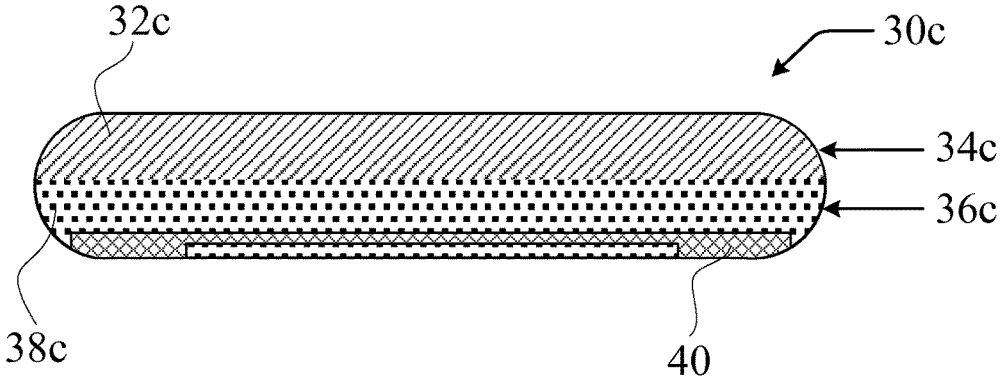
FIG. 3C is a back view of a further embodiment of the flexible film member depicted in the easy open flow wrapper shown in FIGS. 1A and 1B.

The flexible film member may be adhered to the flexible wrapper body film by the use of one or more adhesives, e.g.

pressure sensitive adhesives, disposed on one or more portions of the flexible film member, or alternatively any other type of bonding method using heat sealing, cold sealing, ultrasonic sealing, radio frequency welding, induction welding or combinations thereof. For example, in certain embodiments, as shown in FIG. 3A, the one or more adhesives 32*a* may be entirely disposed onto the flexible film member 30*a*. In other instances, a reduction in bond strength in one or more locations between the flexible film member and the flexible wrapper body film may be desired. For example, in one embodiment as shown in FIG. 3B, the one or more adhesives 32*b* may be disposed entirely onto a top portion 34*b* of the flexible film member 30*b* and an adhesive pattern or kill zone 38*b* may be disposed onto a bottom portion 36*b* of the flexible film member 30*b*. In further embodiments, as illustrated in FIG. 3C, the top portion 34*c* of the flexible film member 30*c* may have one or more adhesives 32*c* disposed thereon and the bottom portion 36*c* of the flexible film member 30*c* may have an adhesive pattern or kill zone 38*c* and additionally a complete kill zone 40 disposed thereon. In certain embodiments, the adhesive pattern or kill zone portion of the flexible film member may be positioned substantially over the line of weakness. Similarly, when using alternative sealing methods, for example heat sealing, such sealing can be patterned to achieve a reduction in bond strength in one or more desired locations between the flexible film member and the flexible wrapper body film.

A reduction in bond strength may be accomplished in a variety of means, including but not limited to the selective application of one or more adhesives over a portion or all of the area in which a reduced bond strength is desired, (e.g., using an adhesive pattern), or through the use of a kill zone. As used herein, the term "kill zone" refers to an area in which the bond strength of the adhesive is reduced as compared to an area with adhesive without the kill zone. For example, a kill zone may be formed by applying one or more adhesives and then applying one or more deadening agents over the one or more adhesives for which the reduction of bond strength is desired. In certain embodiments, a kill zone may be a pattern as illustrated, for example, in FIG. 3B. In other embodiments, a complete kill zone may take the form of a shape as illustrated, for example, in FIG. 3C.

The one or more adhesives may be any known agent or material which provides the desired affinity between the flexible film member and the flexible wrapper body film at the preferred locations. It should be noted that the desired affinity between the flexible film member and the flexible wrapper body film at the preferred locations may be the same or may vary from one another. Non-limiting examples of suitable adhesives materials include acrylics, rubbers, hot glues or combinations thereof.

After opening, the flexible film member remains adhered to the removable portion, which may be either partially or fully separated from the remaining flexible wrapper body. It should be noted that the amount of separation force needed to open the easy open flow wrapper is at least partially based on the overlap positioning of the flexible film member in reference to the at least one line of weakness. In certain embodiments, a minimal amount of the flexible film member may be positioned below the at least one line of weakness. Advantageously, such a position not only enables the easy open flow wrapper to be opened with minimal separation force, but also assists the flexible film member in remaining adhered to the removable portion of the wrapper upon opening and prevents the pre-separation of the removable portion from the flexible wrapper body film.

The method of fabricating that flexible film arrangement for forming an easy open flow provided herein may include providing a flexible wrapper body film, applying a flexible film member over a portion of the flexible wrapper body film; and forming at least one line of weakness in the flexible wrapper body film substantially extending laterally across a portion of the flexible wrapper body film to define a removable portion in the flexible wrapper body film. Thus, the flexible film member overlaps and extends beyond the at least one line of weakness so as to prevent pre-separation of the removable portion from the flexible wrapper body film at the at least one line of weakness. In certain embodiments, the at least one line of weakness is formed in the flexible wrapper body film prior to the application of the flexible film member. Alternatively, in certain embodiments, the at least one line of weakness is formed in the flexible wrapper body film subsequent to the application of the flexible film member.

In certain embodiments, providing a flexible wrapper body film for forming a flexible wrapper body may include using a flexible film of the type commonly employed in the art to produce flow wrappers using a typical vertical or horizontal FFS packaging machine. In some embodiments, the flexible wrapper body film may be constructed of film layers of up to about 400 gauge thickness. The flexible container body film may be mono-layered or multi-layered, and may be printed, clear, laminated, metalized, etc. In certain embodiments, the desired product environment to be maintained within the package drives the types and arrangements of films that are chosen for a particular packaging application. Other considerations can include desired shelf life, and cost. A plurality of package designs are possible, depending on the preceding factors. The materials making up the film layers, primarily plastics, are well known in the art. These materials may vary in cost, as well as in their physical characteristics, such as flexibility, strength, gauge and permeability to substances that decrease the shelf life of a food product, such as oxygen, moisture, and light.

The method for applying the flexible film member onto a portion of the flexible wrapper body film may include adhering the flexible film member to the flexible wrapper body film using any suitable methods known to those skilled in the art. Non-limiting examples include, applying a flexible film member in the form of a die cut label (e.g., using a label applicator); using a patch applicator having a patch cutter and a vacuum application cylinder to die cut a label stock to a desired length and width to produce the flexible film member and then applying the flexible film member to the flexible wrapper body film; applying one or more adhesives to a flexible film member and placing the flexible film member on the flexible wrapper body film; co-extruding a film that is cut to form the flexible film member and applying the flexible film member to the flexible wrapper body film using pressure sensitive adhesive, heat sealing, cold sealing, ultrasonic sealing, radio frequency welding, induction welding or combinations thereof. Further, the flexible film member may be applied to the flexible container body film in off-line or in-line processes with respect to packaging of the product, and also may be formed in both horizontal and vertical FFS operations, among others. For example, the flexible film member may be applied to the flexible wrapper body film in-line just before the flexible wrapper body is formed, filled with product, and sealed. Alternatively, the flexible film member may be applied to the flexible wrapper body film, wound on a reel, and then loaded into vertical or horizontal FFS equipment on which it is then unwound and formed into a flexible wrapper body, filled with product, and sealed.

For example, the flexible film member may be applied to the flexible wrapper body film with the use of one or more adhesives. The one or more adhesives can be applied by anilox rollers, engraved cylinder or other means to the flexible film member in the desired pattern, the amount and type of adhesive agent can be varied to obtain the desired result, and then the flexible film member can be attached to the flexible wrapper body film. Alternatively, the one or more adhesives can be applied to flexible wrapper body film in the same manner as described above, and the flexible film member can then be applied over the one or more adhesives to attach the flexible film member to the flexible wrapper body film. Thus, in either instance, once the flexible wrapper body film that forms the flexible wrapper body reaches the wrapper formation step, the flexible film member is already adhered to the flexible wrapper body film.

The method for forming at least one line of weakness in the flexible wrapper body film may include applying a die cut, score line, or perforated line in the flexible wrapper body film. For example, the at least one line of weakness may be a solid or perforated line formed by a die cut, mechanical score, or laser score. In certain embodiments, the line of weakness does not necessarily have to be straight. For example, in certain embodiments, the at least one line of weakness may be one or more diagonal lines or one or more curved lines.

The easy open flow wrappers provided herein may be used for containing a variety of rigid or semi-rigid products, particularly food products. Non-limiting examples of such products include chocolate and sugar confectionary products, nutraceuticals, cookies, crackers, biscuits and the like. The wrappers are particularly suited for use with generally stick, rectangular or block-shaped products. For example, the wrapper may be used for containing a granola bar or a chocolate bar.

The packaging of a product in an easy open flow wrapper can be achieved using any suitable packaging method, e.g. FFS. In certain embodiments the method of packaging may include providing a flexible wrapper body film having at least one line of weakness defining a removable portion in the flexible wrapper body film and a flexible film member applied over and extending beyond the at least one line of weakness, folding the flexible wrapper body film about the product and forming a longitudinal sealed seam by joining opposite longitudinal edges of the flexible wrapper body film, and forming two lateral end sealed seams. The flexible wrapper body film is configured such that applying a separation force upon the removable portion separates the removable portion from the flexible wrapper body film at the at least one line of weakness and forms an opening in the flexible wrapper body film. The flexible film member is configured to prevent pre-separation of the removable portion from the flexible wrapper body film.

In certain embodiments the flexible wrapper body film is provided as part of a roll of the flexible wrapper body film having a plurality of flexible film members applied over a plurality of respective lines of weakness spaced along the length of the film and the roll is used to package products in a substantially continuous process. In some embodiments, the flexible wrapper body film is cut to separate the easy open flow wrapper from the remainder of the flexible wrapper body film supplied. For example, the roll of flexible wrapper body film is fed through a machine which folds it about each product in turn so that opposing longitudinal edge regions are brought into contact and bonded together to form the longitudinal seam. The flexible wrapper body film is crimped or bonded at opposing ends of the product to form the transverse end seams and the flexible wrapper body film is cut to separate each packaged product from the remainder of the flexible wrapper body film. The longitudinal seam and transverse end seams may be bonded together using heat sealing, cold sealing, ultrasonic sealing, radio frequency welding, induction welding or combinations thereof.

Although the foregoing embodiments describe packaging including a longitudinal seam or which is formed using a flow-wrap process, the description should not be construed as limiting the easy open flow wrappers to such structures. For example, the easy open flow wrappers could be formed with seals along the longitudinal sides of the package instead of or in addition to the longitudinal back seam.

For the purposes of describing and defining the present teachings, it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

It will be appreciated that various above-disclosed and other features and functions, or alternatives thereof, may be desirably combined into many other different products or applications. Various presently unforeseen or unanticipated alternatives, modifications, variations, or improvements therein may be subsequently made by those skilled in the art which are also intended to be encompassed by the following claims.

We claim:

1. A flexible film arrangement for forming an easy open flow wrapper, said flexible film arrangement comprising;

a flexible wrapper body film having at least one line of weakness substantially extending laterally across a portion of the flexible wrapper body film to define a removable portion in the flexible wrapper body film; and a flexible film member disposed over and extending beyond the at least one line of weakness, wherein the flexible film member is configured to prevent pre-separation of the removable portion from the flexible wrapper body film, wherein the flexible film member comprises one or more adhesives, in which the flexible film member is adhered to the flexible wrapper body film via the one or more adhesives, wherein an adhesive pattern of reduced bond strength or a kill zone is positioned over the at least one line of weakness, and wherein the flexible film member is positioned on an inner surface of the flexible wrapper body film, such that the flexible film member faces a storage area of the easy open flow wrapper.

2. The flexible film arrangement of claim 1, wherein application of a separation force upon the removable portion separates the removable portion from the flexible wrapper body film at the at least one line of weakness and forms an opening in the flexible wrapper body film.

3. The flexible film arrangement of claim 1, wherein the flexible film member is further configured to impede moisture or gas from passing through the flexible wrapper body film through the at least one line of weakness.

4. The flexible film arrangement of claim 1, wherein the at least one line of weakness is formed in the flexible wrapper body film between a first end seam portion and a second end seam portion.

5. The flexible film arrangement of claim 4, wherein the at least one line of weakness is disposed at about 3.0 mm to about 15.0 mm from the first or the second end seam portion.

6. The flexible film arrangement of claim 4, wherein the at least one line of weakness is disposed within an upper fifth of the flexible wrapper body film, the upper fifth extending from the first or the second end seam.

7. The flexible film arrangement of claim 4, wherein the at least one line of weakness is disposed a first distance away from the first end seam portion or the second end seam portion, the first distance being from about one tenth to about one fifth of a second distance extending from the first end seam portion to the second end seam portion.

8. The flexible film arrangement of claim 1, wherein the at least one line of weakness extends from a first back panel portion, around and across a front panel portion, and terminates on a second back panel portion.

9. The flexible film arrangement of claim 1, wherein the at least one line of weakness is selected from the group consisting of a die cut, a mechanical score line, a laser score line, a perforated line, and combinations thereof.

10. The flexible film arrangement of claim 1, wherein the flexible film member has a thickness of from about 38.1 microns to about 88.9 microns.

11. A roll of flexible film for forming an easy open flow wrapper, said roll of flexible film comprising the flexible film arrangement of claim 1.

12. A method of fabricating a flexible film arrangement for forming an easy open flow wrapper, said method comprising:

providing a flexible wrapper body film;

applying a flexible film member over a portion of the flexible wrapper body film; and forming at least one line of weakness in the flexible wrapper body film, the at least one line of weakness substantially extending laterally across a portion of the flexible wrapper body film to define a removable portion in the flexible wrapper body film, wherein the flexible film member overlaps and extends beyond the at least one line of weakness, the flexible film member configured to prevent pre-separation of the removable portion from the flexible wrapper body film, wherein the flexible film member comprises one or more adhesives, in which the flexible film member is adhered to the flexible wrapper body film via the one or more adhesives, wherein an adhesive pattern of reduced bond strength or a kill zone is positioned over the at least one line of weakness, and wherein the flexible film member is positioned on an inner surface of the flexible wrapper body film, such that the flexible film member faces a storage area of the easy open flow wrapper.

13. The method of claim 12, wherein an application of a separation force upon the removable portion separates the removable portion from the flexible wrapper body film at the line of weakness and forms an opening in the flexible wrapper body film.

14. The method of claim 12, wherein the flexible film member is further configured to impede moisture or gas from passing through the flexible wrapper body film through the line of weakness.

15. The method of claim 12, wherein the step of forming the at least one line of weakness in the flexible wrapper body film is conducted subsequent to the step of applying the flexible film member over the portion of the flexible wrapper body film.

16. The method of claim 12, wherein the step of forming the at least one line of weakness in the flexible wrapper body film is conducted prior to the step of applying the flexible film member over the portion of the flexible wrapper body film.

17. The method of claim 12, wherein the at least one line of weakness is selected from the group consisting of a die cut, a mechanical score line, a laser score line, a perforated line, and combinations thereof.

18. An easy open flow wrapper, said easy open flow wrapper comprising:

a flexible wrapper body formed from a flexible wrapper body film, the flexible wrapper body having a front panel and a back panel sealed together along one longitudinal seam and two lateral end seams containing a product therein;

at least one line of weakness substantially extending around a portion of the flexible wrapper body to define a removable portion of the flexible wrapper body, such that application of a separation force upon the removable portion separates the removable portion from the flexible wrapper body at the at least one line of weakness and forms an opening in the flexible wrapper body; and a flexible film member disposed over and extending beyond the at least one line of weakness, wherein the flexible film member is configured to prevent pre-separation of the removable portion from the flexible wrapper body, wherein the flexible film member comprises one or more adhesives, in which the flexible film member is adhered to the flexible wrapper body film via the one or more adhesives, and wherein an adhesive pattern of reduced bond strength or a kill zone is positioned over the at least one line of weakness, and wherein the flexible film member is positioned on an inner surface of the flexible wrapper body film, such that the flexible film member faces a storage area of the easy open flow wrapper.

19. The easy open flow wrapper of claim 18, wherein the flexible film member is further configured to impede moisture or gas from passing through the flexible wrapper body through the at least one line of weakness.

20. The easy open flow wrapper of claim 18, wherein the removable portion begins on the back panel of the flexible wrapper body between the longitudinal seam and a first longitudinal side, extends around the first longitudinal side and across the front panel of the flexible wrapper body, and continues around a second longitudinal side to the back panel of the flexible wrapper body where the removable portion terminates between the second longitudinal side and the longitudinal seam.

21. The easy open flow wrapper of claim 18, wherein the longitudinal seam comprises a longitudinal fin seal or a longitudinal lap seal.

22. The easy open flow wrapper of claim 18, wherein the one longitudinal seam is heat sealed or cold sealed.

23. The easy open flow wrapper of claim 18, wherein the two lateral end seams are heat sealed or cold sealed.

24. The easy open flow wrapper of claim 18, wherein the at least one line of weakness is formed in the flexible wrapper body film between the two lateral end seams.

25. The easy open flow wrapper of claim 24, wherein the at least one line of weakness is disposed at about 3.0 mm to about 15.0 mm from one of the two lateral end seams.

26. The easy open flow wrapper of claim 24, wherein the at least one line of weakness is disposed within an upper fifth of the flexible wrapper body, the upper fifth extending from one of the two lateral end seams.

27. The easy open flow wrapper of claim 24, wherein the at least one line of weakness is disposed a first distance away from a first one of the two lateral end seams, the first distance being from about one tenth to about one fifth of a second distance extending from the first one of the two lateral ends seams to a second one of the two lateral end seams.

28. The easy open flow wrapper of claim 18, wherein the at least one line of weakness extends from a first back panel portion, around and across a front panel portion, and terminates on a second back panel portion.

29. The easy open flow wrapper of claim 18, wherein the at least one line of weakness begins on the back panel of the flexible wrapper body between the longitudinal seam and a first longitudinal side, extends around the first longitudinal side and across the front panel of the flexible wrapper body, and continues around a second longitudinal side to the back panel of the flexible wrapper body where the removable portion terminates between the second longitudinal side and the longitudinal seam.

30. The easy open flow wrapper of claim 18, wherein the at least one line of weakness is selected from the group consisting of a die cut, a mechanical score line, a laser score line, a perforated line, and combinations thereof.

31. The easy open flow wrapper of claim 18, wherein the flexible film member has a thickness of from about 38.1 microns to about 88.9 microns.

32. The easy open flow wrapper of claim 18, wherein the product is a food product.

33. The easy open flow wrapper of claim 18, wherein the product is a block-shaped product.

34. A method of packaging a product in an easy open flow wrapper, the method comprising:

providing a flexible wrapper body film having at least one line of weakness defining a removable portion in the flexible wrapper body film and a flexible film member applied over and extending beyond the at least one line of weakness, wherein the flexible film member comprises one or more adhesives, in which the flexible film member is adhered to the flexible wrapper body film via the one or more adhesives, and wherein an adhesive pattern of reduced bond strength or a kill zone is positioned over the at least one line of weakness, and wherein the flexible film member is positioned on an inner surface of the flexible wrapper body film, such that the flexible film member faces the product;

folding the flexible wrapper body film about the product and forming a longitudinal sealed seam by joining opposite longitudinal edges of the flexible wrapper body film; and forming two lateral end sealed seams, wherein the flexible wrapper body film is configured such that applying a separation force upon the removable portion separates the removable portion from the flexible wrapper body film at the at least one line of weakness and forms an opening in the flexible wrapper body film, and wherein the flexible film member is configured to prevent pre-separation of the removable portion from the flexible wrapper body film.

35. The method of claim 34, wherein the removable portion begins on a back panel between the longitudinal seam and a first longitudinal side, extends around the first longitudinal side and across a front panel, and continues around a second longitudinal side to the back panel where the removable portion terminates between the second longitudinal side and the longitudinal seam.

36. The method of claim 34, wherein the flexible wrapper body film is provided as part of a roll of the flexible wrapper body film having a plurality of flexible film members applied over a plurality of respective lines of weakness spaced along the length of the film, the flexible wrapper body film being cut to separate the easy open flow wrapper from the remainder of the flexible wrapper body film.

37. The method of claim 34, wherein the product is a food product.

38. The method of claim 37, wherein the product is a block-shaped product.

* * * * *